US009911585B1

(12) United States Patent
Zabrouskov

(10) Patent No.: US 9,911,585 B1
(45) Date of Patent: Mar. 6, 2018

(54) DATA-INDEPENDENT MASS SPECTRAL DATA ACQUISITION INCLUDING DATA-DEPENDENT PRECURSOR-ION SURVEYS

(71) Applicant: Thermo Finnigan LLC, San Jose, CA (US)

(72) Inventor: Vladimir Zabrouskov, Belmont, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 15/387,522

(22) Filed: Dec. 21, 2016

(51) Int. Cl.
*H01J 49/00* (2006.01)

(52) U.S. Cl.
CPC ..... *H01J 49/0031* (2013.01); *H01J 49/0036* (2013.01)

(58) Field of Classification Search
CPC ..... H01J 49/00; H01J 49/02; H01J 49/0081; H01J 49/0031; H01J 49/0027; H01J 49/0036
USPC ..... 250/281, 282
See application file for complete search history.

(56) References Cited

U.S. PATENT DOCUMENTS 7,297,941 B2 11/2007 Senko et al.
7,511,267 B2 3/2009 Zabrouskov
8,053,723 B2 11/2011 Senko
8,148,677 B2 4/2012 Zhang et al.
8,168,943 B2 5/2012 Schwartz et al.
8,809,770 B2 8/2014 Bonner et al.
8,809,772 B2 8/2014 Bonner et al.
8,935,101 B2 1/2015 Wright
9,269,553 B2 2/2016 Bonner et al.
2017/0069475 A1* 3/2017 Brown ..... H01J 49/0031

OTHER PUBLICATIONS

Bern et al., "Identification of Peptides from Ion-Trap Data-Independent Tandem MS", Poster, Proceedings of the 56th ASMS Conference on Mass Spectrometry and Allied Topics, Denver, CO, Jun. 1-5, 2008.

(Continued)

*Primary Examiner* — Jason McCormack
(74) *Attorney, Agent, or Firm* — Thomas F. Cooney

(57) ABSTRACT

A mass spectrometry method comprises: acquiring a series of survey mass spectra of first-generation ions generated from a sample; acquiring a series of fragment-ion mass spectra, each being a record of a respective set of fragment-ion species generated by fragmentation of a respective subset of the first-generation ions within a respective mass-to-charge isolation range; adjusting mass spectrometer operational parameters used to acquire a later one of the survey mass spectra based on results of an earlier one of the survey mass spectra; dividing the acquired series of fragment-ion mass spectra into a first group wherein an appearance of a fragment-ion species correlates with the appearance of a first-generation ion species observed in a survey mass spectrum and a second group wherein no obvious correlation is observed between fragment-ion species and first-generation ion species; and mathematically processing the spectra of the first and second groups by different mathematical procedures.

16 Claims, 9 Drawing Sheets

(56) References Cited

OTHER PUBLICATIONS

Egertson et al., "Multiplexed MS /MS for improved data independentacquisition", Nature Methods, 2013, vol. 10 (8), pp. 744-748.
Gillet, et al., "Targeted Data Extraction of the MS/MS Spectra Generated by Data-independent Acquisition: A New Concept for Consistent and Accurate Proteome Analysis", Molecular & Cellular Proteomics 11.6, 2012, pp. 1-17.
Panchaud et al., "Precursor Acquisition Independent From Ion Count: How to Dive Deeper into the Proteomics Ocean", Anal. Chem. 2009, 81, pp. 6481-6488.
Venable et al., "Automated approach for quantitative analysis ofcomplex peptide mixtures from tandem mass spectra", Nature Methods, 2004, vol. 1 (1), pp. 1-7.

* cited by examiner

DATA-INDEPENDENT MASS SPECTRAL DATA ACQUISITION INCLUDING DATA-DEPENDENT PRECURSOR-ION SURVEYS

FIELD OF THE INVENTION

The invention relates generally to mass spectrometry techniques for analyzing biomolecules.

BACKGROUND OF THE INVENTION

Mass spectrometry has become the method of choice for fast and efficient identification of proteins in biological samples. In particular, tandem mass spectrometry of peptides derived from a complex protein mixture can be used to identify and quantify the proteins present in the original mixture. In general practice, such information is obtained by ideally selecting and isolating single ion species (of a single mass-to-charge ratio, or m/z, value or of a restricted range of m/z values) and subjecting such so-isolated precursor ions to fragmentation so as to yield product ions that can be used to identify peptides. Ion fragmentation can be provided by various methodologies and mechanisms including collision-induced dissociation (CID), infrared multiphoton dissociation (IRMPD). In these dissociation methods, kinetic or electromagnetic energy is imparted to the peptide ions, whereby the introduced energy is converted into internal vibrational energy that is then distributed throughout the bonds of the peptide ions. When the energy imparted to a particular bond exceeds that required to break the bond, fragmentation occurs and product ions are formed. Other mechanisms of fragmentation include for example, those in which the capture of a thermal electron is exothermic and causes the peptide backbone to fragment by a non-ergodic process, those that do not involve intramolecular vibrational energy redistribution. Such methodologies include Electron Capture Dissociation (ECD) and Electron Transfer Dissociation (ETD). ECD and ETD occur on a time scale that is short compared with the internal energy distribution that occurs in the CID process, and consequently, most sequence specific fragment forming bond dissociations are typically randomly along the peptide backbone, and not of the side-chains.

The information that is derived from tandem mass spectrometry experiments comprises a list of m/z values of fragment ions as well as correlations between the fragment-ion m/z values and the m/z values of the precursor ions from which the fragments were derived. This information can be used to search peptide sequence databases to identify the amino acid sequences represented by the spectrum and, thus, to identify the protein or proteins from which the peptides were derived. To identify peptides, database searching programs typically compare each MS/MS spectrum against amino acid sequences in the database, and a probability score is assigned to rank the most likely peptide match.

Because tandem mass spectra of peptide mixtures are generally complex, data-dependent data acquisition techniques have been developed in order to systemize mass spectral analyses. During data-dependent acquisition, an initial survey mass spectrum of potential precursor ions is obtained prior to fragmentation. Automated processing of the survey mass spectrum identifies the most abundant ionized species which are then selected for subsequent isolation and fragmentation followed by mass analysis of fragments (Fejes et al. Shotgun proteomic analysis of a chromatophore-enriched preparation from the purple phototrophic bacterium *Rhodopseudomonas palustris*. Photosynth Res. 2003; 78(3):195-203). If data is being obtained from a sample undergoing chromatographic separation, this sequence of events may be repeated as each fraction elutes (i.e., at each of a plurality of chromatographic retention times). A data-dependent method that makes use of this process is schematically illustrated at 10 in FIG. 1A.

Boxes 12 in FIG. 1A schematically represent survey mass spectra that are conducted so as to determine the m/z values of the various ion species that are introduced into a mass spectrometer at any particular time. Since mass-to-charge ratio (m/z) values are represented as ordinate values and chromatographic retention time values are represented as abscissa values in FIG. 1A, the height of the boxes 12 represents the m/z range of the survey mass spectral measurements. For purposes of example only, the common height of the boxes 12 is representing a survey mass spectral range from 400 Da to 1200 Da, which is a common range of interest. Each survey mass spectrum (or, equivalently, survey "scan") is a measurement of the relative abundances and mass-to-charge ratios of first-generation ion species as produced by an ion source and as delivered to a mass analyzer and possibly including some proportion of fragment ions generated in an uncontrolled fashion by in-source fragmentation. The positions of the boxes 12 represent the various times (retention times) at which the survey mass spectra are obtained and correspond to the elution of different respective sample fractions that are introduced into a mass spectrometer. Generally, such survey spectra will be obtained at approximately regular time intervals. Although only five survey mass spectra are indicated in FIG. 1A, the actual number of such survey spectra obtained during the course of an LCMS experiment may hundreds or even thousands. The widths of the boxes shown in FIG. 1A do not have any significance; generally, the time required to obtain any individual mass spectrum is exceedingly small relative to the time over which elution occurs.

According to a so-called "shotgun" type of data-dependent analysis, each survey mass spectrum is automatically analyzed, in real-time during the course of the experiment, to identify the most abundant first-generation ions being introduced into the mass spectrometer at the time of the survey measurement. The most abundant ions give rise to the most intense lines in the mass spectrum. Thus, the m/z values of the most intense lines are identified and recorded. Subsequently, an ion species having each identified m/z value (more correctly, having a restricted, isolated range of m/z that encompass a particular identified m/z value) is respectively isolated within the mass spectrometer and subjected to fragmentation in a collision cell or other fragmentation cell so as to generate one or more fragment ions (product ion species). The isolated first-generation ion species and ions that are to be fragmented or that have been fragmented to produce identified product ion species are herein referred to as "precursor ion species" or "precursor ions". Each one of the boxes 14 in FIG. 1A schematically represent an occurrence of isolation of a particular ion species followed by fragmentation of that ion species and analysis of the so-generated product ions. The ordinate position of each box 14 represents the m/z value of a hypothetical observed precursor ion; the product ions generated by fragmentation of each precursor ion may comprise a range of product-ion m/z values (not specifically indicated by any box) throughout the measurement range of interest. The occurrence of ten such boxes 14 after the occurrence of each one of the first four survey mass spectra (boxes 12) are shown so as to represent the identification, isolation and fragmentation of each of ten most abundant precursor ion species. The different patterns of boxes 14 after each one of the first four survey mass spectra represents that the signatures of different ion species may dominate different survey spectra, since the appearances of different ion species correlate with the chromatographic elution of different respective compounds.

FIG. 4A illustrates a generalized schematic depiction of an analysis system 200 comprising a liquid chromatograph and mass spectrometer (e.g., an LCMS system) as may be employed to generate tandem mass spectra corresponding to mass spectral experiments of the type discussed in this document. In the system 200, a liquid chromatograph 202 provides a stream of liquid eluate to an ion source 204 of the mass spectrometer through a fluidic conduit 203. The ion source which may, without limitation, comprise an electrospray, thermospray or Atmospheric Pressure Chemical Ionization (APCI) source generates a plume of ions of various species which are introduced into an evacuated chamber 206 of the mass spectrometer through an aperture or tube 207 thereof.

A first set of ion optical components 208*a* of the mass spectrometer of the analysis system 200 directs the ions into an ion selection, mass analysis or storage device 210 which may comprise, without limitation, a quadrupole mass filter, a quadrupole ion trap or a quadrupole mass analyzer. In some modes of operation, the device 210 may be operated so as to isolate a selected population of ion species, in accordance with a selected m/z value or range of m/z values. In other modes of operation, the device 210 may be operated so as to generate a mass spectrum or mass spectra of the ions that are introduced into the evacuated chamber. A second set of ion optical components 208*b* directs ions from the device 210 into a fragmentation cell 212. The fragmentation cell may operate according any one of several mechanisms including, without limitation, collision-induced dissociation (CID), infrared multiphoton dissociation (IRMPD), Electron Capture Dissociation (ECD) and Electron Transfer Dissociation (ETD).

Fragment ions (i.e., product ions) generated within the fragmentation cell 212 are directed, by means of a third set of ion optical components 208*c*, to a mass analyzer 214 that includes an ion detector 216. The mass analyze 214 may be any one of various different mass analyzer types and may comprise, without limitation, a quadrupole mass filter, a quadrupole ion trap, a time-of-flight (TOF) mass analyzer, a magnetic sector mass analyzer, an electrostatic trapping mass analyzer, such as an orbital trapping mass analyzer or a Cassini trap mass analyzer or a Fourier Transform Ion Cyclotron Resonance (FT-ICR) mass analyzer. Each mass spectrum, which may be of either precursor ion species or product ion species, that is generated by the mass analyzer 214 and detector 216 is a record of relative detected abundances of ions of different m/z values.

The detector 216 of the analysis system 200 (FIG. 4A) communicates such mass spectral data to an electronic controller 218, such as a computer, circuit board, or set of modular integrated circuit components, over an electronic communication line 221. Other electronic communication lines 221 may also be present within the system 200 so as to electronically couple the controller 218 to the chromatograph 202, the ion source 204, the ion selection, mass analysis or storage device 210, the fragmentation cell 212, the mass analyzer 214 or the various ion optical assemblies (208*a*-208*c*). The electronic communication lines 221, which may be either unidirectional or bi-directional, may be employed to send operational instructions from the controller to any of these various components (as well as others) or to receive information from any of these components (as well as others). The controller 218 includes computer-readable electronic memory 219 and may operate according to control instructions (such as a computer program) stored on the electronic memory. The control instructions may comprise instructions to cause the various components of the analysis system 200 to operate in a coordinated fashion so as to execute various mass spectrometry methods as described in this document.

Although the system 200 has been described in terms of LCMS as comprising a liquid chromatograph 202 that supplies a chemically fractionated sample to a mass spectrometer, it should be kept in mind that, alternatively, an unfractionated sample could be supplied to the mass spectrometer through simple infusion or that, still further alternatively, some other form of chemical separation technique or chemical fractionation technique could be used in conjunction with or in place of the chromatograph 202. For example, the system could make use of apparatus corresponding to additional or other techniques that are known in the art of chemical separation, such as liquid-liquid extraction, solid phase supported liquid extraction, random access media column extraction, monolithic column extraction, dialysis extraction, dispersive solid phase extraction, solid phase micro-extraction, etc. Such alternatively configured systems may also be employed to generate tandem mass spectra corresponding to mass spectral experiments of the type discussed in this document.

In many instances, certain method steps may be advantageously performed using a mass spectrometer system that comprises more than one mass analyzer. FIG. 4B schematically illustrates one such system, which is marketed and sold under the Thermo Scientific™ Orbitrap Fusion™ mass spectrometer name by Thermo Fisher Scientific of Waltham, Mass. USA. The system 300 illustrated in FIG. 4B is a composite system comprising multiple mass analyzers including: (a) a dual-pressure linear ion trap analyzer 340 and (b) an ORBITRAP™ oribital trapping mass analyzer (a type of electrostatic trap analyzer) 360. A key performance characteristic of this instrument is its high duty cycle, which is realized by efficient scan scheduling, so that survey mass spectra are acquired with one analyzer while product-ion mass spectra are acquired with the other analyzer. In addition to the two mass analyzers, the system 300 further includes a quadrupole mass filter 333 which may be employed for isolation of various ranges of precursor ions, a C-trap ion trap 350 which is operational to route ions into the Orbitrap™ mass analyzer and an ion-routing multipole ion guide 309 which may be configured to either store ions or fragment ions by collision-induced dissociation (CID) and is capable of routing ions in the direction of either the C-trap ion trap 350 or the dual-pressure linear ion trap analyzer 340.

The dual-pressure linear ion trap analyzer 340 comprises a high-pressure cell portion 340*a* and a low-pressure cell portion 340*b*. The high-pressure cell portion 340*a* may be infused with either an inert gas for purposes of enabling ion fragmentation by collision-induced dissociation or with a reagent gas for purposes of enabling ion fragmentation by electron transfer dissociation (ETD). The low-pressure cell portion 340*b* is maintained under high vacuum and includes ion detectors 341 for operation as a linear ion trap mass analyzer. Thus, the system 300 provides ion fragmentation capability in either the multipole ion guide 309 or in the high-pressure cell portion 340*a* of the dual-pressure linear ion trap analyzer 340.

In operation of the system 300, ions introduced from ion source 312 are efficiently guided and focused into an evacuated chamber by stacked ring ion guide 302. A bent active beam guide 307 causes ions to change their trajectory whereas neutral molecules follow a straight-line trajectory which enables them to be vented by the vacuum system (not illustrated). The ions then pass into the quadrupole mass filter which may be operated, in known fashion, such that only ions comprising a certain pre-determined m/z range or ranges pass through in the direction of the C-trap 350. From the C-trap, ions may be directed into the ORBITRAP™ oribital trapping mass analyzer for high-accuracy mass analysis or may be caused to pass into the multipole ion guide 309 or the ion trap analyzer 340 for either fragmentation, mass analysis or both. After fragmentation, product ions may be routed back to the C-trap 350 for subsequent injection into the ORBITRAP™ oribital trapping mass analyzer for high-accuracy mass analysis.

FIG. 1B is a schematic illustration of a hypothetical sequence of events and hypothetical investigated m/z ranges in accordance with a conventional targeted mass analysis procedure which may be variously known or referred to as selected ion monitoring (SIM), selected reaction monitoring (SRM) or multiple reaction monitoring (MRM). The targeted analysis method shown generally at 20 of FIG. 1B makes use of the fact that, for many biological molecules, a highly reliable identification may be made by detecting a precursor ion species of a particular m/z value and, subsequently, after fragmenting that ion species, detecting fragment ions of one or more particular product-ion m/z values.

As previously described with regard to FIG. 1A, m/z values of precursor (first-generation) ion species are represented as ordinate values and chromatographic retention time values are represented as abscissa values in FIG. 1B. Survey mass spectra are illustrated by hollow boxes 22*a*-22*d*. Boxes 22*a* represent survey spectra that are conducted so as to detect a first-generation ion species having an m/z value of m1, if present. Likewise, boxes 22*b*, 22*c* and 22*d* represent survey spectra that are conducted so as to detect, if present, different first-generation ion species having m/z values of m2, m3, and m4, respectively. These targeted m/z values (m1-m4) are selected in advance of the experiment. As one example, each such ion species may possibly represent the presence, in the eluate, of a respective particular compound of interest. Because only specific ion species are searched for in a targeted experiment, each survey mass spectrum (22*a*-22*d*) is designed to analyze only a relatively narrow m/z range about the targeted value.

Because different compounds chromatographically elute at different times, specifically targeted ions will not be detected at all times. The targeted ion species will only be detected during the elution of the respective corresponding compound of interest (that gives rise to the respective ion species) or during elution of some other compound that gives rise to an ion species that coincidentally comprises an m/z value similar to that of the targeted ion species. Once the targeted m/z value is detected (and only when it is detected), the detected ion species is isolated and fragmented and the resulting fragment (product) ions are mass analyzed. The detection, fragmentation and product-ion investigation of precursor ions having m/z values of m1, m2, m3 and m4 are respectively indicated by lines 24*a*, 24*b*, 24*c* and 24*d* in FIG. 1B. Accordingly, FIG. 1B indicates that a compound that gives rise to a precursor ion species having an m/z value of m1 elutes approximately between time t2 and time t5, inclusive (range 26*a*). Likewise, as indicated in the same figure, ion species having the m/z values of m1, m2, m3 and m4 elute within the ranges 26*b*, 26*c* and 26*d*, respectively. Once a compound of interest has been detected, by recognition of one or more targeted precursor-ion m/z values and one or more targeted product-ion m/z values, then these m/z values may be excluded from further searches by placement on a so-called "exclusion list". Such exclusion is indicated by the dotted-line boxes 22*a*, 22*b* and 22*c* in FIG. 1B. Note that the product ions generated by fragmentation of each precursor ion may comprise a range of m/z values (not specifically indicated by any box) throughout the measurement range of interest.

With regard to most analyses of biological samples, neither of the data-dependent analysis methods indicated at 10 in FIG. 1A or at 20 in FIG. 1B is capable of generating a fully comprehensive list of all proteins or peptides that may be present in a sample. The targeted analysis method (FIG. 1B) is not designed to do so. With regard to the shotgun approach (FIG. 1A), numerous studies showing the non-reproducible nature of peptides detected in replicate analyses of the same sample (Panchaud et al. Faster, quantitative, and accurate precursor acquisition independent from ion count. Anal Chem. 2011 Mar. 15; 83(6):2250-7) have demonstrated that that such methods fail to provide full coverage of peptides in a complex mixture. The shotgun approach only detects the most abundant peptides; numerous other low-abundance peptide compounds that may co-elute together with the abundant peptides remain below a requisite intensity threshold or are indistinguishable from spectral "noise". Moreover, when numerous peptides co-elute, the nature of the chromatographic experiment does not provide sufficient time for separate isolation, fragmentation and fragment analysis for every possible candidate m/z value.

The analysis technique known as "data-independent acquisition" was developed in an attempt expand the number of proteins and peptides that may be detected by LCMS analysis of natural samples. Such expanded coverage could aid an understanding of the complexity of the proteome and the significance of the low-abundance proteome. Such experiments are generally performed without isolation of specific first-generation ion species as precursor ions. Instead, reliance is placed upon computational mining of comprehensive mass spectral data sets obtained from experiments in which first-generation ion species encompassing a wide range of m/z values are simultaneously fragmented so as to generate complex product-ion spectra containing multiplexed signatures of all fragment ions. Although data-independent acquisition methods can provide a comprehensive list of all possible fragment ions, there is generally no direct recorded "parent-child" relationship between precursor ions and fragment ions. Such methods have been made possible by improvements in mass spectrometer speed, accuracy and resolution (thereby limiting interferences between a multitude of mass spectral lines) as well as by the development of mass spectral libraries and advanced computational processing techniques.

FIG. 1C is a highly schematic diagram, shown generally at 30, illustrating the general sequence of events that may occur during a hypothetical LCMS analysis performed according to one data-independent acquisition method known as "SWATH MS" (Gillet et al., Targeted Data Extraction of the MS/MS Spectra Generated by Data-independent Acquisition: A New Concept for Consistent and Accurate Proteome Analysis, Mol. Cell. Proteomics, 2012, 11(6): O111.016717. DOI: 10.1074/mcp.O111.016717) and often used in conjunction with SWATH™ quantitative proteomics software. In similarity to previously discussed diagrams, m/z values of precursor ions or first-generation ions are represented as ordinate values and chromatographic retention time values are represented as abscissa values. The SWATH MS data-independent procedure includes consecutively acquiring a series of high-resolution, accurate-mass fragment-ion spectra during an entire chromatographic elution (retention time) range by repeatedly stepping through a number (for example thirty two) discrete precursor-ion isolation windows of a certain width (for example, 25 Da width) across a full mass spectral range of interest (for example, the 400-1200 m/z range). Thus, a main feature of the technique, as illustrated in FIG. 1C, is a plurality of series of consecutive product-ion analyses 34. Each such product ion analysis 34 is represented as a shaded box and includes the steps of: isolation of precursor ions within a restricted range of m/z values, fragmentation of the isolated precursor ions so as to generate fragment ions and mass analysis of the fragment ions generated from the isolated precursor ions (i.e., a fragmentation scan). Each restricted range of precursor m/z values may be termed an "isolation window" (or, equivalently, an "isolation range" or an "isolated range") and is represented by the range of ordinate values that is spanned by a respective one of the boxes 34. For example, the isolation ranges represented by the first several boxes 34, beginning at the lower left position, of FIG. 1C are 400-430 Da, 420-450 Da, 440-470 Da, 460-490 Da, 480-510 Da, etc. Isolation ranges are indicated similarly in other of the accompanying figures. The width of the isolation windows (height of the boxes 34) is significantly greater than those of isolation windows employed in standard shotgun and targeted (FIGS. 1A-1B) methods and are represented, in FIG. 1C, by the height of the shaded boxes that represent the product ion analyses. It should be noted that the product ions, themselves, that are generated by fragmentation of set of precursor ions may comprise a different range of product-ion ink values (not specifically indicated by any box).

Two series, 35*a* and 35*b*, of product-ion analyses are illustrated in FIG. 1C. Consecutive isolation windows (corresponding to consecutive product-ion analyses) partially overlap one another in m/z to assure that there are no ink gaps within which ink positions of unfragmented first-generation ions occur. Once the series of isolation windows has covered the full ink range of interest (i.e, once an end of the full ink range of interest has been reached), then a new series of consecutive product-ion analyses is investigated in similar fashion starting at the opposite end of the range. As used herein, the term "cycle time" is the time required to return to the acquisition of any given precursor isolation window. The boxes 32 outlined with dashed lines at the beginning of each cycle depict optional acquisition of a high-resolution, accurate mass survey scan of precursor ions throughout the full ink range of interest. The totality of data product-ion analyses 34 corresponding to any given precursor mass range across the range of retention times is oftentimes referred to as a "swath". One such swath is shown at 38 in FIG. 1C.

After the collection of mass spectral data as depicted in FIG. 1C, certain targeted peptide or protein compounds may be recognized by mathematical processing of the data. Conventional peptide database search engines, as utilized in conjunction with the shotgun technique illustrated in FIG. 1A, require information relating to which specific fragment ions (more correctly, which ink values) are generated from any given precursor m/z. Disadvantageously, such information is not generally recorded using the data-independent acquisition method illustrated in FIG. 1C. Therefore, such data-independent acquisition methods cannot use conventional database search engines for data processing. Instead, the targeted data processing used to mine the complex data set generated by a data-independent experiment such as that illustrated in FIG. 1C makes use of reference mass spectral libraries. Such libraries may include previously determined reference spectra of known compounds and may include information such as the m/z positions and relative intensities of mass spectral lines as well as chromatographic retention times and other associated information. To perform the targeted data extraction of information (for example, relating to a peptide of interest) from an experiment of the type illustrated in FIG. 1C, the most intense fragment ions of the peptide of interest are retrieved a reference mass spectral library. Patterns of correlated fragment-ion m/z positions, relative intensities and elution profiles are then matched to the reference information to recognize patterns of signals that can uniquely identify the targeted compound or compounds.

Although data-independent mass spectral acquisition methods similar to that schematically illustrated in FIG. 1C have been successfully employed in various circumstances, they may be associated with various disadvantages in certain other circumstances. For example, when measuring highly complex mass spectra, a potential problem of fragment ion interference depends on the product-ion analysis isolation window width. For instance, a wide window width decreases cycle time, which is advantageous when elution peaks are of short-duration, as is characteristic of good chromatographic separation. However, the same wide window width increases the chance of co-isolation of many first-generation ion species, including interfering background ions, prior to fragmentation, thereby increasing the possibility of interferences in the product ion spectra. Decreasing the window width may be expected to decrease the number of first-generation ion species that are co-isolated but, in this instance, the chromatography must be of poorer resolution in order to accommodate the resulting longer cycle times. Further, the rate of product ion interference also depends on the mass accuracy and resolution of the fragment isolation window during data analysis. There remains a need for improved methods of mass spectral analysis of complex mixtures of biological molecules.

SUMMARY

In order to address the above-noted need in the art of mass spectral analysis, mass spectral methods are described which combine aspects of both data-dependent and data-independent mass spectrometry. A mass spectral data acquisition may include measurement cycles that include both acquisition of survey mass spectra of first-generation ions as well as a series data-independent product-ion analyses, where each such product-ion analysis includes the steps of: isolation of precursor ions within a restricted isolation window, fragmentation of the isolated precursor ions so as to generate fragment ions and mass analysis of the fragment ions generated from the precursor ions that were isolated in the corresponding isolation window. Initially, survey spectra m/z windows are all a same default width, and the isolation windows of the product-ion analyses are all a same default width. However, the width of the survey scan windows and the width product-ion analysis isolation windows width do not correlate. During each measurement cycle, each survey mass spectral window is analyzed to assess various spectral attributes, including the density of the precursor ions, degree of ion-ion coalescence, unresolved features and others. Various parameters of subsequent survey mass spectral windows or the product-ion analyses may then be adjusted based on the determined attributes.

The goal of data-dependent parameter adjustment of the survey spectra is to maximize the quality (quantitative, qualitative or both) of the survey spectra and to improve the chance of correlating observed parent ions with fragment ions in a subsequent computational data processing step. The various parameters of the survey mass spectra product-ion analyses that may be adjusted based on information derived from prior survey scans may include, without limitation: (a) survey spectra window widths; b) survey spectra m/z positions; (c) ion injection time duration for subsequent ion injections; (d) a target maximum number of ions to inject during subsequent ion injections; (e) mass spectral system resolution; (f) which mass spectral component device or mass analyzer to employ for isolating or mass analyzing ions (in the case of mass spectrometer systems that include multiple such component devices or mass analyzers); (g) ion source conditions; and (h) number of survey spectra to acquire across an m/z range.

Once the mass spectral data acquisition for a sample is complete, product-ion spectral data is sorted into two groups: (a) a first group in which one or more precursor ions are present and are obvious in a survey mass spectrum; and (b) a second group in which precursor ions are either absent or not obvious. Spectra of the first group undergo subsequent computational processing with the benefit of precursor mass or isotope ratios or both. Retention time information and elution profile matching can be used, in such cases, to better correlate possible precursors with possible fragments. Spectra of the second group undergo subsequent computational processing relying only on the spectra of the fragment ions in accordance with conventional methods for processing such data, including the use of mass spectral libraries.

If there are mass spectral data regions for which the computational processing steps of both groups of spectra fail to provide adequate identification or quantification, a second mass spectral acquisition is scheduled in which the mass spectral operating parameters of survey mass spectra or product-ion analyses or both are further optimized. In this second mass spectral data acquisition, additional survey mass spectra can be scheduled in order to quantify components identified in the first data acquisition or to search for parent/child ion correlations that failed to be made in the prior computational processing step.

BRIEF DESCRIPTION OF THE DRAWINGS

The above noted and various other aspects of the present invention will become further apparent from the following description which is given by way of example only and with reference to the accompanying drawings, not drawn to scale, in which.

DETAILED DESCRIPTION

Figure 1A:
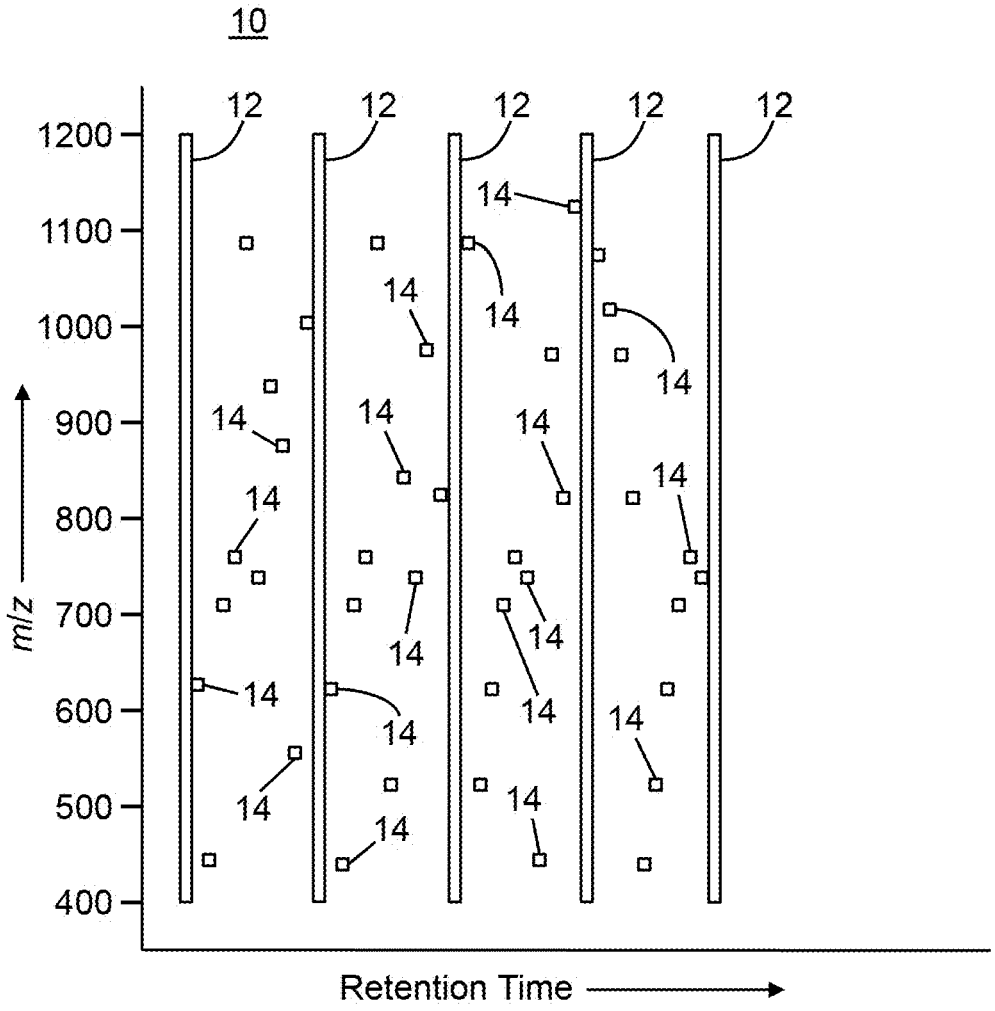
FIG. 1A (Prior Art)
FIG. 1A is a schematic illustration of the sequencing and m/z ranges of a hypothetical series of survey mass spectra and a hypothetical series of fragment mass spectra as may be obtained during a conventional data-dependent tandem mass spectral analysis of chromatographically eluting analytes.
Figure 1B:
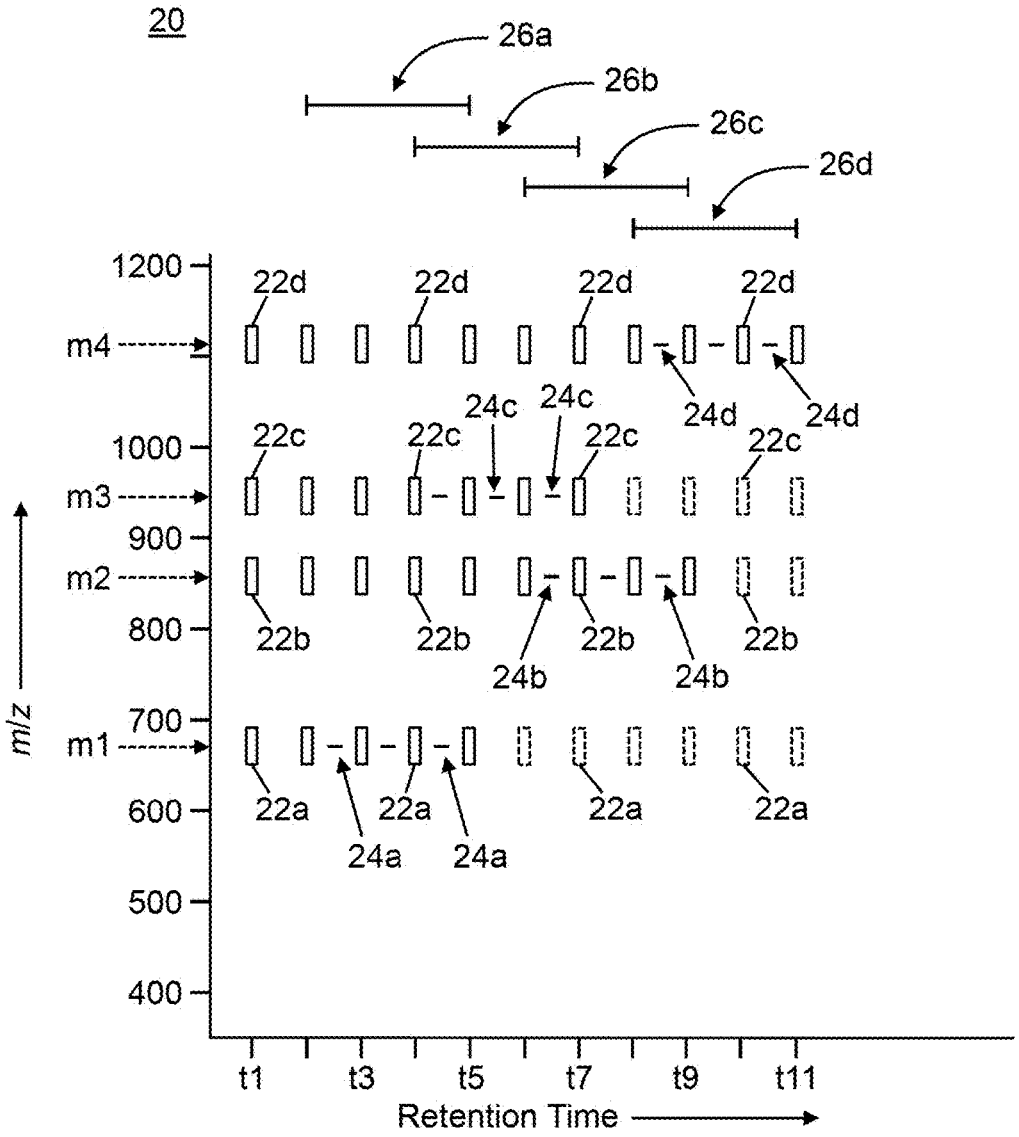
FIG. 1B (Prior Art)
FIG. 1B is a schematic illustration of the sequencing and m/z ranges of a hypothetical series of precursor-ion mass spectra and a hypothetical series of fragment-ion mass spectra as may be obtained during a conventional selected-ion monitoring mass spectral analysis of chromatographically eluting analytes.

The following description is presented to enable any person skilled in the art to make and use the invention, and is provided in the context of a particular application and its requirements. Accordingly, the disclosed materials, methods, and examples are illustrative only and not intended to be limiting. Various modifications to the described embodiments will be readily apparent to those skilled in the art and the generic principles herein may be applied to other embodiments. Thus, the present invention is not intended to be limited to the embodiments and examples shown but is to be accorded the widest possible scope in accordance with the features and principles shown and described. The particular features and advantages of the invention will become more apparent with reference to the FIGS. 1A, 1B, 1C, 2A, 2B, 3A, 3B, 4A and 4B taken in conjunction with the following description.

Unless otherwise defined, all technical and scientific terms used herein have the meaning commonly understood by one of ordinary skill in the art to which this invention belongs. In case of conflict, the present specification, including definitions, will control. In this document, the terms "first-generation ions" and "first-generation ion species" refer to ions as they are received by a mass analyzer from an ionization source in the absence of any controlled fragmentation in a fragmentation cell. Such "first-generation ions" and "first-generation ion species" may, however, possibly include some proportion of fragment ions generated in an uncontrolled fashion by in-source fragmentation. The terms "products", "product ions", "product ion species", "fragments", "fragment ions", and "fragment ion species" refer to ions or ion species generated by controlled fragmentation of a subset of the first-generation ions in a fragmentation cell or reaction cell. The subset of first-generation ions that are fragmented or that will be fragmented or that have been fragmented are referred to as "precursor ions" or "precursor ion species". The term "scan", when used as a noun, should be understood in a general sense to mean "mass spectrum" regardless of whether or not the apparatus that generates the scan is actually a scanning instrument. Similarly, the term "scan", when used as a verb, should be understood in a general sense as referring to an act or process of acquiring mass spectral data.

It will be appreciated that there is an implied "about" prior to the quantitative terms mentioned in the present teachings, such that slight and insubstantial deviations are within the scope of the present teachings. In this application, the use of the singular includes the plural unless specifically stated otherwise. Also, the use of "comprise", "comprises", "comprising", "contain", "contains", "containing", "include", "includes", and "including" are not intended to be limiting.

As used herein, "a" or "an" also may refer to "at least one" or "one or more." Also, the use of "or" is inclusive, such that the phrase "A or B" is true when "A" is true, "B" is true, or both "A" and "B" are true. Further, unless otherwise required by context, singular terms shall include pluralities and plural terms shall include the singular.

Figure 2A:
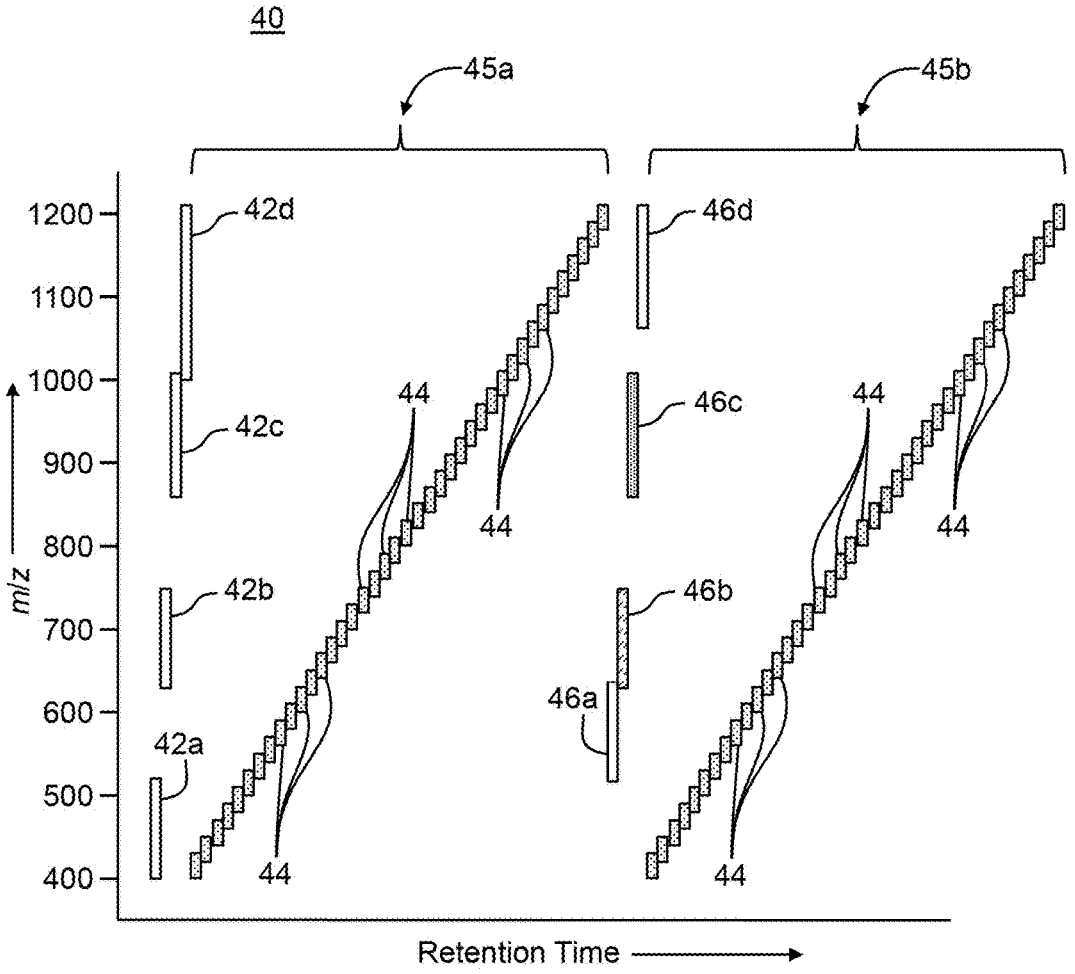
FIG. 2A is a schematic illustration of the sequencing and m/z ranges of a hypothetical series of survey mass spectra and a hypothetical series of fragment mass spectra as may be obtained during a tandem mass spectral analysis of chromatographically eluting analytes in accordance with a first embodiment in accordance the present teachings.
Figure 2B:
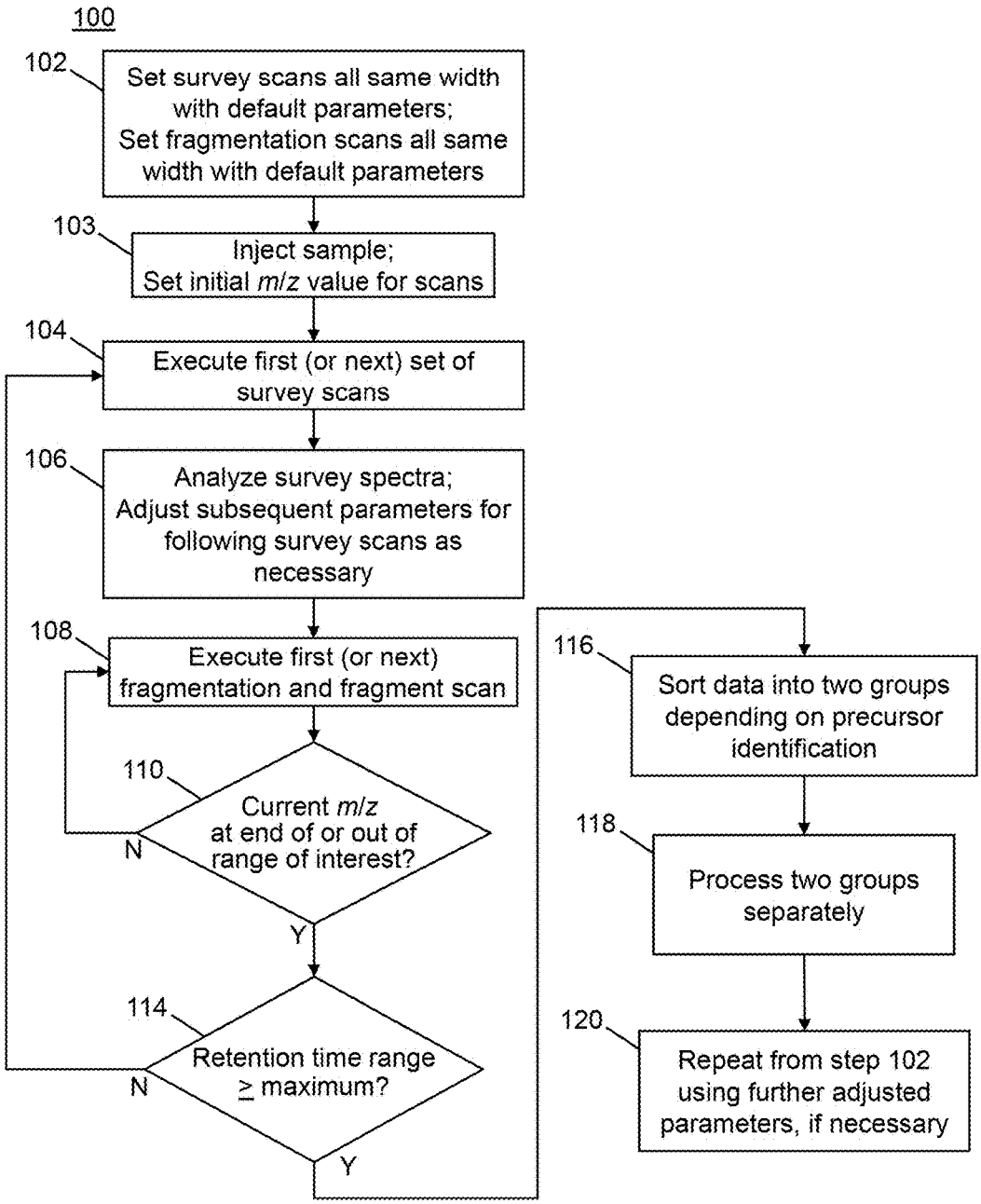
FIG. 2B is a flow diagram of an exemplary method of tandem mass spectral analysis in accordance with the present teachings.

FIG. 2A is a schematic illustration, indicated generally at 40, of a hypothetical sequence of events and hypothetical investigated m/z ranges in accordance with the present teachings. FIG. 2B is a flow diagram of a method, method 100, of tandem mass spectral analysis in accordance with the present teachings. FIGS. 2A-2B are applicable to LCMS analysis in which: a liquid sample is separated into various fractions by a liquid chromatograph; the eluate (comprising the various fractions) is supplied to an ion source of a mass spectrometer; the ion source ionizes the sample, thereby producing first-generation ions; and the mass spectrometer analyzes either the first-generation ions or second-generation ions produced by fragmentation of the first-generation ions.

In similarity to previously discussed diagrams, m/z values of precursor or first-generation ion species are represented as ordinate values and chromatographic retention time values are represented as abscissa values in FIG. 2A. Like the data-independent analysis technique illustrated in FIG. 1C, the data analysis method illustrated in FIG. 2A includes a plurality of series of consecutive product-ion analyses 44. Each such product-ion analysis 44 includes: isolation of precursor ions within a restricted isolation window (represented, in FIG. 2A, by the positions and heights of the shaded boxes representing the product-ion analyses), fragmentation of the isolated precursor ions so as to generate fragment ions and mass analysis of the fragment ions generated from the isolated precursor ions (i.e., a fragmentation scan). Note that the product ions generated by fragmentation of each precursor ion may comprise a range of product-ion m/z values (not specifically indicated by any box) throughout the measurement range of interest. Two series of product-ion analyses, 45*a* and 45*b*, are illustrated in FIG. 2A. Consecutive isolation windows (corresponding to consecutive product-ion analyses) partially overlap one another in m/z to assure that there are no m/z gaps within which m/z positions of unfragmented first-generation ions occur or, in other words, that there are no m/z positions, within the m/z range of interest, that are not within the m/z range of at least one isolation window. Once the series of isolation windows has covered the full m/z range of interest (i.e, once an end of the full m/z range of interest has been reached), then a new series of consecutive product-ion analyses is performed in similar fashion starting at the opposite end of the range.

Figure 1C:
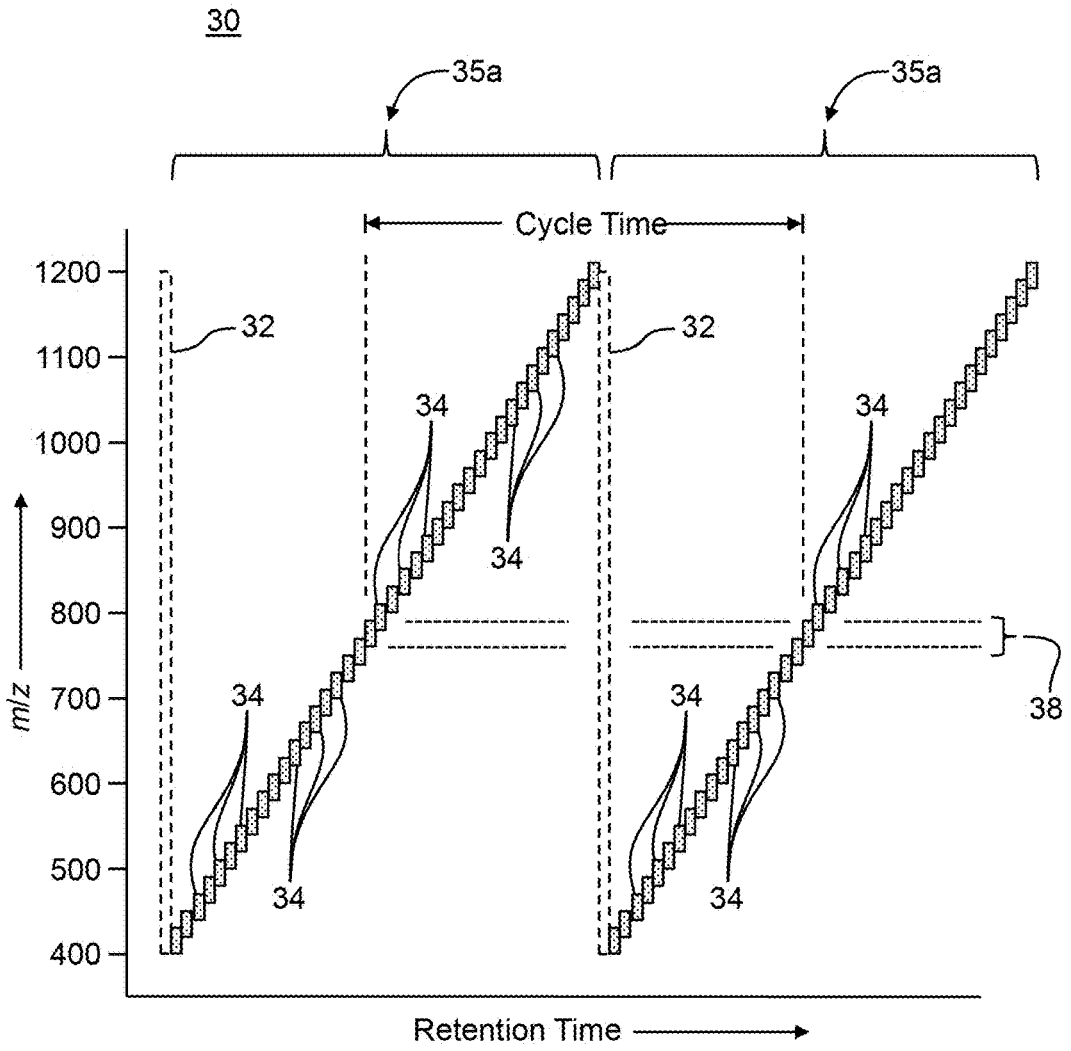
FIG. 1C (Prior Art)
FIG. 1C is a schematic illustration of the sequencing and m/z ranges of a hypothetical series of fragment mass spectra and optional survey mass spectra as may be obtained during a conventional data-independent mass spectral analysis of chromatographically eluting analytes.

The analysis method illustrated in FIG. 2A and outlined in FIG. 2B differs from the conventional data-independent analysis strategy as depicted in FIG. 1C through the provision of a respective group of precursor-ion survey scans prior to the occurrence of each series of consecutive isolation windows. Two such groups of precursor-ion survey scans are illustrated in FIG. 2A—a first group prior to the series 45*a* of product-ion analyses and comprising individual survey scans 42*a*-42*d* and a second group prior to the series 45*b* of product-ion analyses and comprising individual survey scans 46*a*-46*d*. A single measurement cycle consists of a group of survey scans and the immediately following series of product-ion analyses 44. For example, FIG. 2A depicts two such measurement cycles although, in practice, a single experiment may comprise tens, hundreds or thousands of such cycles. If a mass spectrometer system having multiple mass analyzers (e.g., see FIG. 4B, which depicts a mass spectrometer system comprising separate mass analyzers 340 and 360) is used in the practice of the method 100, (FIG. 2B), then, according to some embodiments of the present teachings, a first one of the mass analyzers may be used to acquire the survey mass spectra 42*a*-42*d* and a second one of the mass analyzers may be used to acquire the fragmentation scans associated with the product-ion analyses 44.

Each precursor-ion survey scan of a group represents a mass spectral measurement of first-generation ions within a restricted ink range that is narrower than the full range of interest. Each such survey scan is provided so as to identify possible precursor ions of interest within its respective restricted ink range. The ink values of candidate precursor ions of interest may be identified or known (i.e., predetermined), prior to data acquisition, as corresponding to certain targeted analyte compounds. In such instances, each survey scan may comprise a search to determine whether the predetermined candidate precursor ions are present in the population of first-generation ions at the time of measurement, as in a targeted experiment (e.g., FIG. 1B). However, the ink range of each survey scan (survey scans 42*a*-42*d* and 46*a*-46*d*) may encompass the ink values of more than one candidate precursor ions of interest. Moreover, although FIG. 2A is illustrated with gaps in ink measurement ranges between consecutive survey scans, there may be some instances in which there are no gaps in ink measurement ranges between consecutive survey scans or instances in which the ink measurement ranges of survey scans at least partially overlap. For example, although respective ink gaps occur between survey scans 42*a* and 42*b*, between survey scans 42*b* and 42*c*, between survey scans 46*b* and 46*c* and between survey scans 46*c* and 46*d*, there is partial overlap between the ink ranges of survey scans 42*c* and 42*d* and between the ink ranges of survey scans 46*a* and 46*b*. In some instances, the m/z ranges of a set of survey scans may span an entire ink range of interest (for example, the range 400-1200 Da as shown in FIG. 2A) without any ink gaps.

In step 102 of the method 100 and prior to the start of data acquisition, the window widths (m/z ranges) of the survey scans (42*a*-42*d*) may all be set to a same default value. Also, the window widths and m/z positions of the isolation windows 44 are all set to default values which do not subsequently change over the course of an experiment. Generally, the window widths of all isolation windows 44 are identical and the positions of the isolation windows are chosen so as to span an entire ink range of interest (for example, the range 400-1200 Da as shown in FIG. 2A) without any ink gaps between isolation windows. Preferably, the isolation ranges of consecutive isolation windows partially overlap one another. In general, the window widths of the survey scans are independent of the widths of the isolation windows 44.

The window widths of the survey scans may be either wider or narrower than the widths of the isolation windows.

In step 103, an initial or starting ink value is set and a sample is injected into a liquid chromatograph, thereby commencing the separation of the sample into fractions by the chromatograph and the supplying of a continuous stream of eluate into a mass spectrometer coupled to the chromatograph. The initial or starting ink value is the ink value at the beginning of the m/z-range of first-generation ion species to be investigated (either mass analyzed, fragmented or both). For example, with reference to the specific example shown in FIG. 2A, the m/z-range is 400-1200 Da and the starting m/z value is 400 Da, assuming that the analysis (or scanning) of ions proceeds from low m/z values to high m/z values. It should be kept in mind, however, that the analysis could proceed in the opposite direction, from high m/z values to low m/z values. In this latter situation, the starting m/z value would be 1200 Da.

Steps 104-110 of the method 100 comprise a single measurement cycle, as defined above. During each measurement cycle, a set of survey mass spectra are acquired (step 104) and the data in each survey spectral scan window is analyzed (step 106) to assess various spectral attributes, including the density of the precursor ions, degree of ion-ion coalescence, unresolved features and others. For example, with reference to FIG. 2A, the survey mass spectra 42*a*-42*d* are acquired and analyzed in the first measurement cycle. These spectral attributes are used to subsequently adjust operational parameters employed during the acquisition of the survey scans in the following measurement cycle. The goal of such data-dependent parameter adjustment of the survey scans (i.e., the mass spectra of first-generation ions) is to maximize the quality (quantitative, qualitative or both) of the first-generation-ion spectra and to improve the chance of correlating (during a post-acquisition data processing step) precursor ions, as observed in the survey scans, with the fragment ions, as observed in the fragmentation scans. In step 108, each product-ion analysis 44 is performed, in turn. Each product-ion analysis 44 includes ion isolation within a respective isolation window, fragmentation and fragmentation analysis steps, as previously noted. Step 110 is a loop control step for the series of product-ion analysis. If an ending ink value (e.g., 1200 Da with reference to the particular example illustrated in FIG. 2A) has been reached or surpassed, then the current series of product-ion analyses terminates and execution of the method 100 passes to step 114. Otherwise, the ink range of the next isolation window is incremented accordingly and step 108 is executed again using the new isolation window.

Although the survey spectral analysis and parameter adjustment step (step 106) is indicated as occurring prior to steps 108-110 in FIG. 2B, it alternatively could be executed after step 110. The categories of operational parameters that may be adjusted in step 106, based on the analysis of prior survey scans, may include, without limitation: (a) survey spectra window widths; (b) survey spectra ink positions; (c) ion injection time duration for subsequent ion injections; (d) a target maximum number of ions to inject during subsequent ion injections; (e) mass spectral system resolution; (f) which mass spectral component device or mass analyzer to employ for isolating or mass analyzing ions (in the case of mass spectrometer systems that include multiple such component devices or mass analyzers); (g) ion source conditions; and (h) number of survey spectra to acquire across an ink range.

The adjustments of survey spectra window widths and ink positions and number of survey spectra across an ink range may be made in response to a determination of an under-utilization or an over-utilization of m/z-space (within an m/z region of interest) made from analyses of attributes of prior survey spectra. For example, certain regions of m/z-space may include clusters of mass spectral lines of first-generation ions whereas other regions may be sparsely populated. The adjustments to survey spectral window widths and m/z positions may be made so as to concentrate information gathering at the locations of the clusters. In some instances, the adjustments to survey spectral window widths and m/z positions may cause the m/z ranges of consecutive survey scans to abut one another or to overlap. In some instances, the adjustments to survey spectral window widths and m/z positions may produce a gap in the first-generation-ion m/z measurement range at an m/z position at which no such gap existed in an immediately preceding measurement cycle. Likewise, adjustments to mass spectral resolution may be made in response to the determination of either a dense or a sparse population of mass spectral lines of first-generation ions within a certain region of m/z space. Since increasing data acquisition may correlate with a longer required data acquisition time, such adjustments may be made in association with concurrent adjustments to survey spectral window widths in order to efficiently utilize a limited amount of time that available for data acquisition as imposed by chromatographic peak widths. If more than one mass analyzer is available within a mass spectrometer system (e.g., see FIG. 4B) and the different mass analyzers provide different spectral resolution performance, then the resolution adjustment may be accomplished by switching to a different one of the mass analyzers.

Adjustments to ion injection time duration, targeted maximum number of ions to be injected and ion source conditions may be made in response to a determination, from analysis of a prior survey mass spectrum, of a flux of first-generation ions within a certain m/z range into the mass spectrometer. Such adjustments may be made in order to best utilize the dynamic range of an ion detector of the mass spectrometer. If more than one mass analyzer is available within a mass spectrometer system (e.g., see system 300 of FIG. 4B, comprising mass analyzers 340 and 360) and the different mass analyzers provide different dynamic range performance, then the resolution adjustment may be accomplished by switching to a different one of the mass analyzers.

Step 114 of the method 100 is a loop control step for the measurement cycles that comprise a single experiment. Generally, an experiment ends once a maximum retention time or a maximum elapsed time has been reached or exceeded. Retention time may be measured relative to an initial injection (step 103) or relative to some other defined event. In step 114, the current value of the retention time is compared to a maximum value and, if the current value is less than the maximum value, execution of the method 100 returns to step 104 at which a next measurement cycle begins. Otherwise, execution is transferred to step 116.

FIG. 2A schematically illustrates various adjustments to the survey scans 46*a*-46*d* based on hypothetical analyses of attribute of the prior survey scans 42*a*-42*d*. For example, the heights of the boxes of survey scans 42*a*, 42*b*, 42*c* and 42*d* indicate initial scan window widths of 120 Da, 120 Da, 150 Da and 210 Da, respectively (these values have no particular significance; actual window widths employed in practice may be wider or narrower). However, in the second measurement cycle, the window width of survey mass spectrum 46*d* is decreased to 148 Da, relative to the window width of prior survey scan 42*d*, as indicated by the relative heights of the representative boxes. Further, the m/z position of survey mass spectrum 46*a* is shifted relative to the position of survey mass spectrum 42*a*, indicating acquisition of data encompassing a different mass spectral range during the second measurement cycle. Finally, the boxes representing survey scans 42*a*-42*d*, 46*a* and 46*d* are all unpatterned, indicating the use of default values of operational parameter during these mass spectral acquisitions. However, the two boxes representing survey scans 46*b* and 46*c* are represented by different patterns, indicating changes in instrumental operational parameters used during the acquisitions of the spectral data.

In FIG. 2A, each series of 45*a*, 45*b* of product-ion analyses 44 is indicated as commencing after the completion of a set of survey mass spectral acquisitions (42*a*-42*d*, 46*a*-46*d*). This sequence of events is consistent with the use of a single mass analyzer for both the survey mass spectra (of first-generation ions) and the fragment-ion mass spectra. However, if more than one mass analyzer is available within a single mass spectrometer system (e.g, see system 300 of FIG. 4B, comprising mass analyzers 340 and 360), then different respective mass analyzers may be employed for acquiring the two different types of mass spectra. In such a case, at least a portion of the survey mass spectra may be acquired concurrently with the performing of the product-ion analyses 44. Similarly, if the mass spectrometer system comprises more than one device or subsystem that is able to selectively select and isolate ion species within a restricted m/z range (e.g., see FIG. 4B, which depicts a mass spectrometer system in which either the quadrupole mass filter 333 and ion C-trap 350 or the linear ion trap 340 may be used in this fashion), then a first such device or subsystem may be used to isolate first-generation ions to be measured in the survey spectra and a second device or subsystem may be used to isolate fragment ions to be measured in fragmentation spectra, thereby using available time efficiently.

Once the entire data acquisition has been completed, the fragment-ion data (acquired in the full set of product-ion analyses 44) is sorted into two groups (step 116): a first group in which one or more precursor ions are present and obvious in a respective corresponding survey mass spectrum; and a second group in which no precursor is evident in the respective corresponding survey mass spectrum. In some instances, precursor ions may be recognized in a survey scan by a confirmation of a mass spectral line at an expected m/z position or by the occurrence of a series of associated mass spectral lines (such as a pattern of lines correlative with or indicative of a sequence of charge states or an isotopic distribution). In other instances, the presence of a precursor ion and its association with certain fragment ions may be recognized by observing a correlation between the observed retention time or elution profile of the precursor ion with the retention time or elution profiles of the one or more fragment ions. In other instances, a precursor ion within an overlapping region of m/z coverage ion isolation windows in preparation for fragmentation (e.g., see overlapping regions of product-ion analyses 44 in FIG. 2A) may be recognized by virtue of occurrence of a matching subset of fragment ions in two consecutively obtained product ion spectra. The development of such correlated or matched precursor and fragment ions can lead to an interpretation that the fragment and precursor ion species are related as child and parent.

The two groups fragment-ion data are computationally processed separately (step 118). The first group of product ion mass spectra is processed with the benefit of precursor mass/and or isotope ratio and may employ standard database matching techniques as employed in shotgun analysis methods. For example, the presence of a certain peptide (or other biological) within a sample may be recognized from the data of the first group of product-ion spectra by identifying a particular observed product ion as having been (or possibly having been) derived by fragmentation of a particular precursor ion. By comparison of the precursor- and fragment-ion m/z values with entries in a database of tabulated precursor-ion and fragment-ion m/z values, the conjectured presence of the peptide (or other biological molecule) may be confirmed. The second group of product ion spectra is processed only relying on the fragment-ion data and may employ automated recognition of correlations between the line positions, line intensities and elution profiles of the acquired fragment-ion data with entries of mass spectral libraries (libraries of mass spectra of known compounds) as described above. This processing of the second group of product-ion spectra can lead to the recognition of additional peptides (or other biological molecules) for which precursor ions are not observed by an experiment.

If there are mass spectral data regions for which the computational processing steps of both groups of spectra fail to provide adequate identification or quantification, a second mass spectral acquisition is scheduled (step 120) in which the mass spectral operating parameters of survey mass spectra or product-ion analyses or both are further optimized. In this second mass spectral data acquisition, additional survey mass spectra can be scheduled in order to quantify components identified in the first data acquisition or to search for parent/child ion correlations that failed to be made in the prior computational processing step.

Figure 3A:
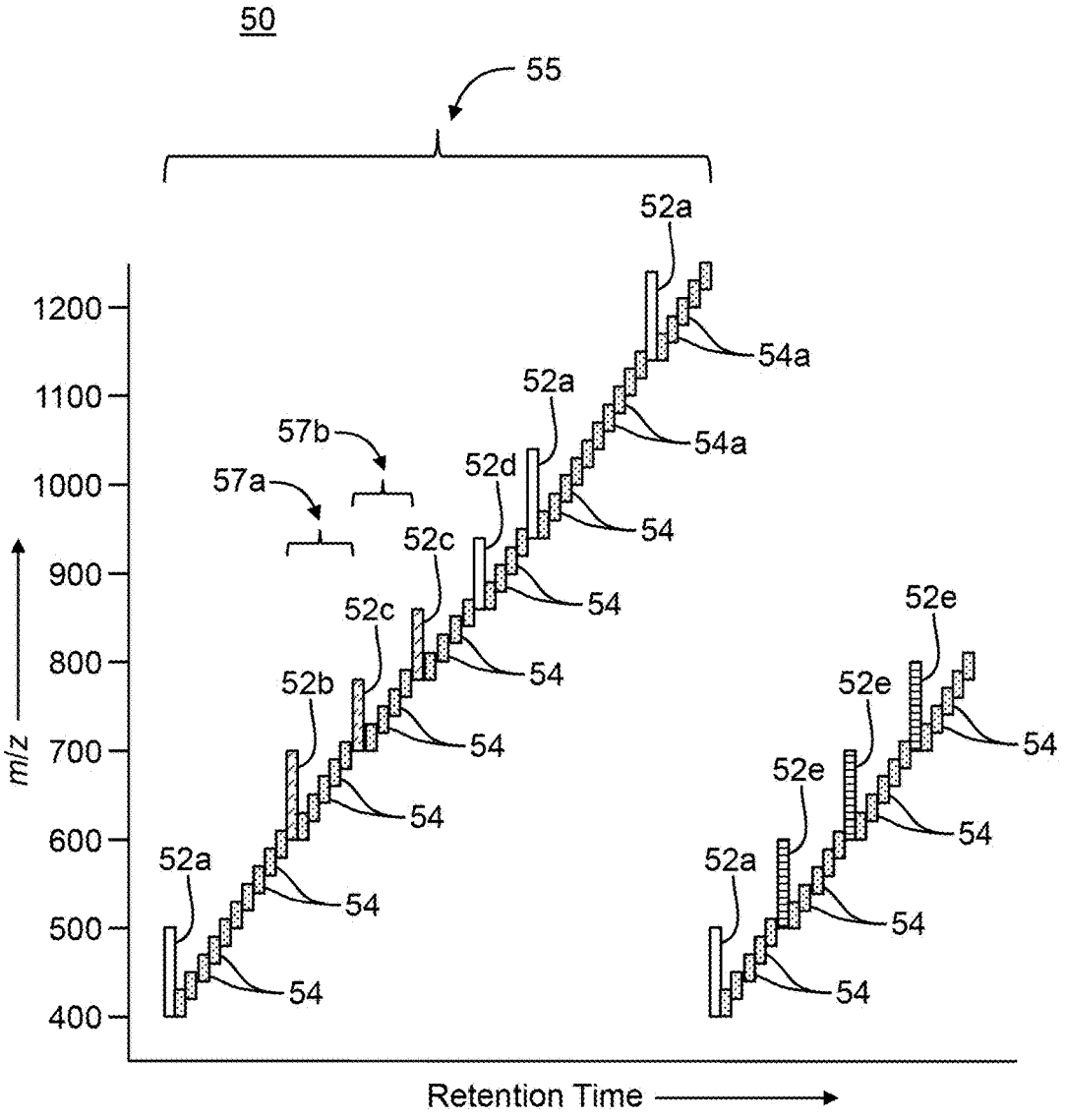
FIG. 3A is a schematic illustration of the sequencing and m/z ranges of a hypothetical series of survey mass spectra and a hypothetical series of fragment mass spectra as may be obtained during a tandem mass spectral analysis of chromatographically eluting analytes in accordance with a second embodiment in accordance the present teachings.

FIG. 3A is a schematic illustration of an example, shown generally at 50, of an alternative sequence of survey mass spectra and product-ion analyses in accordance with the present teachings. As in other examples previously described herein, mass-to-charge ratio (m/z) values are represented as ordinate values and chromatographic retention time values are represented as abscissa values in FIG. 3A. The various product-ion analyses 54 depicted in FIG. 3A are performed approximately similarly to the performing of the product-ion analyses 44 as depicted in FIG. 2A. Specifically, each individual product-ion analysis 54 includes: isolation of precursor ions within a restricted isolation window (represented, in FIG. 3A, by the height of the shaded boxes representing the product-ion analyses), fragmentation of the isolated precursor ions so as to generate fragment ions and mass analysis of the fragment ions generated from the isolated precursor ions (i.e., a fragmentation scan). The collection of product-ion analyses are grouped in separate sequences, wherein the m/z range of each isolation window corresponding to a product-ion analyses in a sequence (except for the first such isolation window) is shifted in m/z relative to and partially overlaps with the m/z range of the isolation window of the immediately preceding product-ion analysis such that there are no m/z positions, within the m/z range of interest, that are not within the m/z range of at least one isolation window. As shown, the shifting of the m/z isolation coverage between consecutive product-ion analyses in a sequence may generally be performed from low m/z to high m/z over a range of interest (in the example, from 400 Da to 1200 Da) of precursor ions. Nonetheless, the shifting of the m/z isolation coverage may also be performed from high m/z to low m/z. As in the previous example, once the isolation coverage has extended up to or beyond an end of the range of interest, the positioning of the isolation window of a first product-ion analysis of a subsequent sequence of product-ion analyses returns to the opposite end of the m/z range of interest, as illustrated in FIG. 3A.

Survey scans 52*a*-52*e* of first-generation ions, as depicted in FIG. 3A, are performed approximately similarly to the performing of the survey scans 42*a*-42*d* as depicted in FIG. 2A, with the main difference being that the performing of the survey scans 52*a*-52*e* is interspersed with the performing of the product ion analyses within each sequence of product-ion analyses. This type of experiment (i.e., as illustrated in FIG. 3A and summarized in FIG. 3B) may be useful when chromatographic elution peaks are narrow as compared to the measurement speed of the mass spectrometer system. The m/z measurement window width (Δ[m/z]) of each survey scan is indicated by the height of the boxes representing the particular survey scan. The type of shading applied to each box that represents a survey scan is representative of a set of instrumental operational parameters used to perform the scan, apart from m/z measurement range and m/z measurement window width. Thus, for example, all survey mass spectral scans labeled as 52*a* in FIG. 3A comprise a same first set of instrumental operational parameters (indicated by unshaded boxes) and a same m/z measurement window width. The survey scan 52*d* comprises the same first set of operational parameters but a different m/z measurement window width. The survey scans 52*b* and 52*c* (whose boxes are shaded similarly) comprise a same second set of operational parameters but different m/z measurement window widths, etc. The various different survey scans 52*a*-52*e* schematically indicate five different combinations of parameters and measurement window widths but, in practice there may either be fewer or more than this number of different types of survey scans.

Figure 3B:
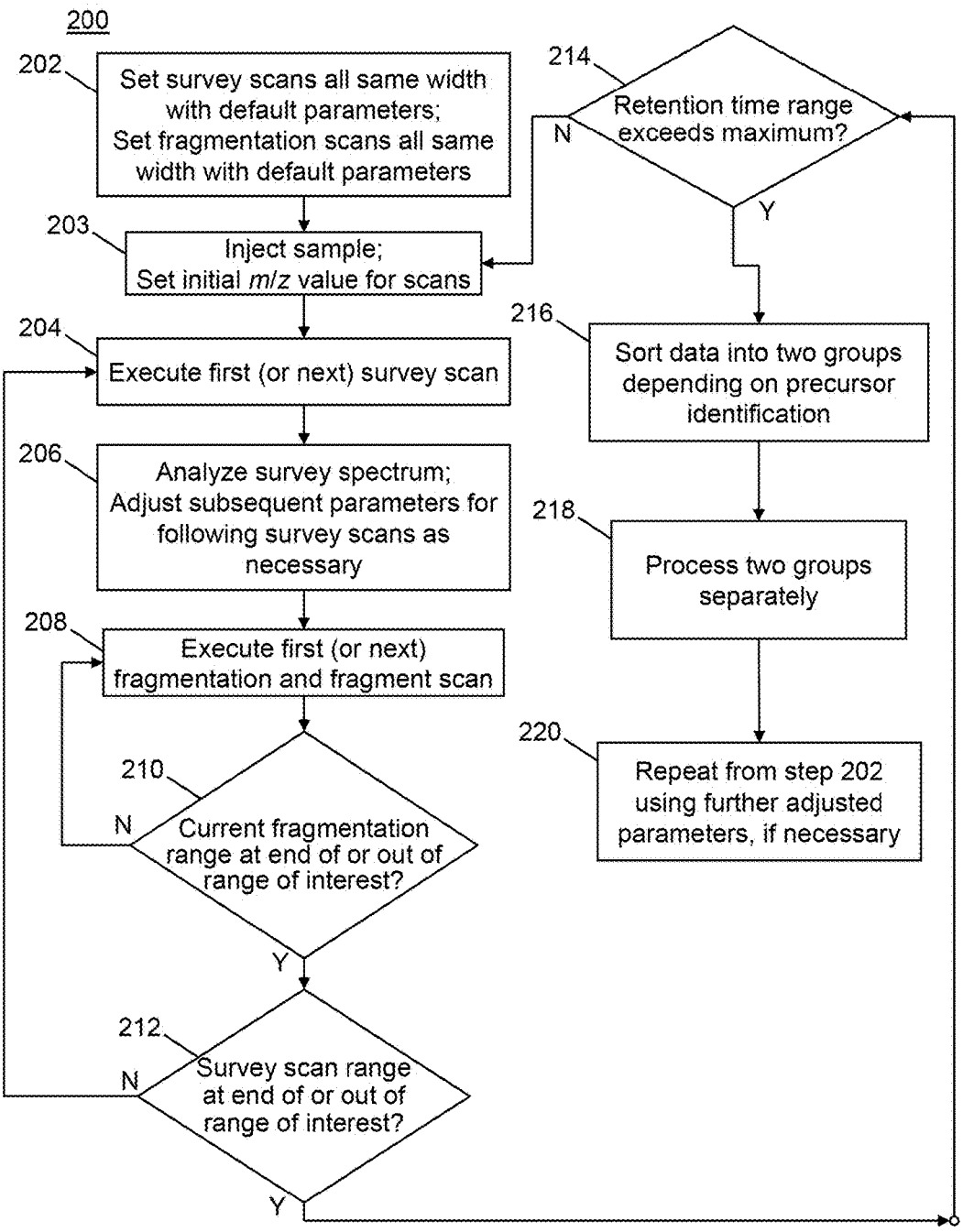
FIG. 3B is a flow chart of a second exemplary method of tandem mass spectral analysis in accordance with the present teachings.
Figure 4A:
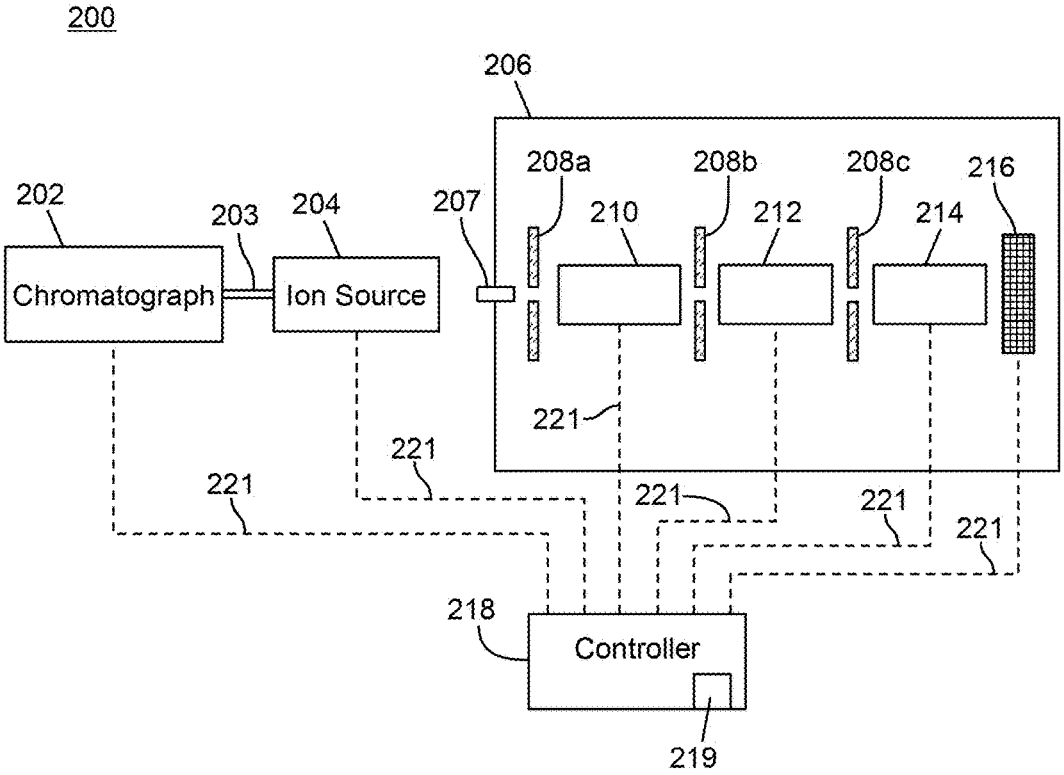
FIG. 4A (Prior Art)
FIG. 4A is a schematic depiction of a coupled chromatograph and mass spectrometer system upon which various method steps in accordance with the present teachings may be practiced.
Figure 4B:
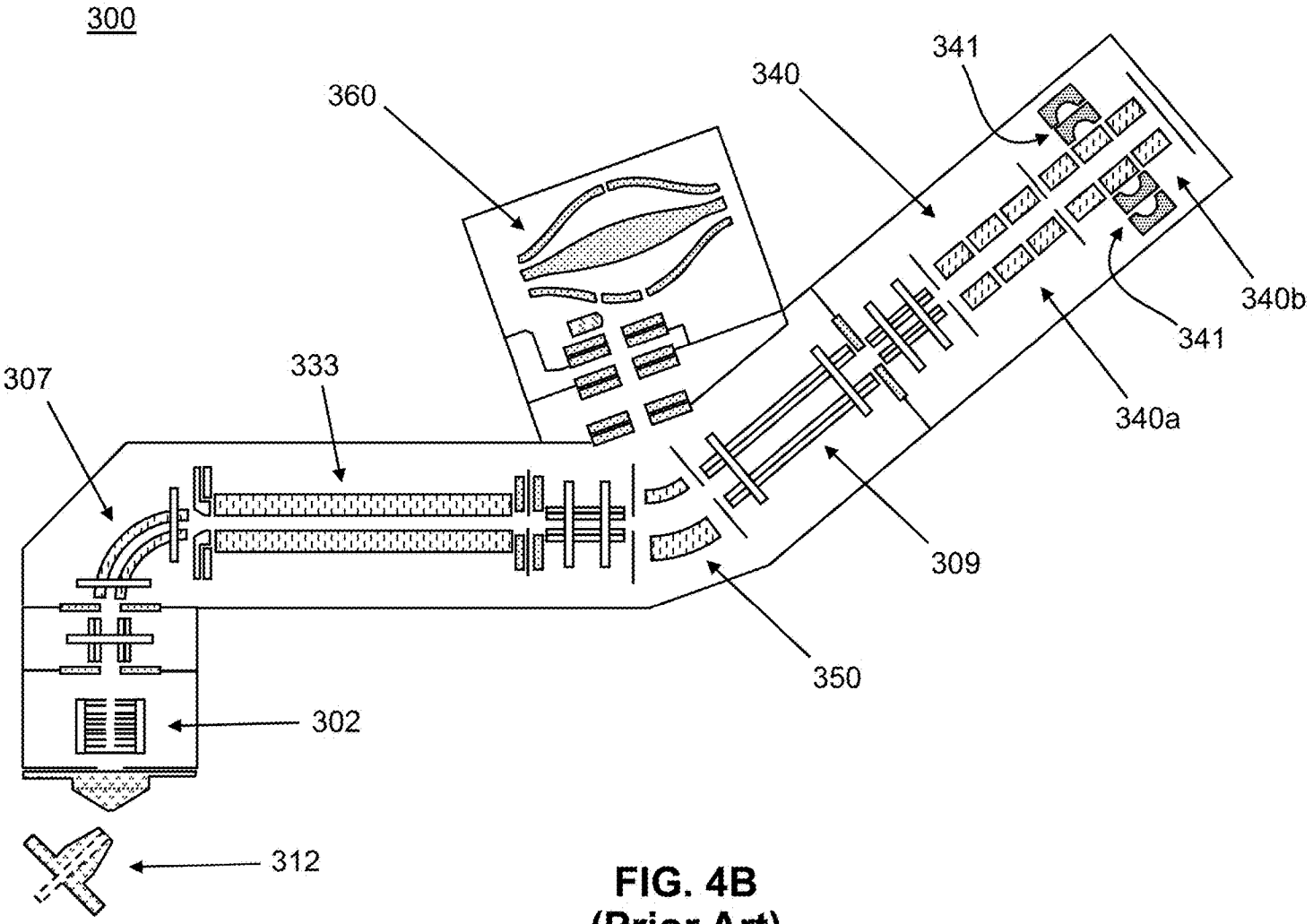
FIG. 4B (Prior Art)
FIG. 4B is a schematic illustration of a known multi-component, multi-analyzer mass spectrometer system upon which method steps in accordance with the present teachings may be practiced.

FIG. 3B is a flow diagram of a method, method 200, of tandem mass spectral analysis in accordance with the present teachings and that corresponds to the sequence of events as indicated in FIG. 3A. The may or may not be gaps or overlaps in m/z measurement ranges between consecutive survey scans. The number, m/z measurement ranges, m/z measurement window widths, operational parameters and frequency of occurrence of the various survey scans may be adjusted during data acquisition in response to mass spectral attributes determined through analysis of prior survey scans. The types of operational parameters that may be varied in response to the determined mass spectral attributes are as previously described in reference to FIGS. 2A-2B. One or more product-ion analyses 54 are performed during the time periods between consecutive survey scans. Because the number of survey scans is not necessarily constant, neither the time duration of a measurement cycle 55 nor the number of product-ion analyses 54 occurring between consecutive survey scans is necessarily constant.

For example, the span of time indicated as 57*a* in FIG. 3A comprises a survey scan 52*b* and five subsequent product-ion analyses 54 prior to the occurrence of the next survey scan 52*c* (shown with a shaded box). The next time span 57*b* is shorter in that it only includes four product-ion analyses. In the example shown in FIG. 3A, the m/z window width of the survey mass spectrum 52*b* is 100 Da and this survey scan is immediately followed by five product-ion analyses that all comprise isolation windows of 30 Da width that overlap adjacent isolation windows by 10 Da. Accordingly, these five product-ion analyses generate fragments of precursor ions that may be observable in the survey spectrum 52*b*. In this example, the lower end of the range of survey scan 52*c* (represented by a shaded box) is positioned at 700 Da, which is just the upper end of the range of survey scan 52*c*, so as to avoid a gap in mass spectral coverage of first-generation ions. However, the window width of this survey scan is just 80 Da. Therefore, only four product-ion analyses 54 immediately follow this survey scan (together, corresponding to time span 57*b*) before a next survey scan 52*c* (represented by an unshaded box) is required so as to once again avoid a gap in first-generation ion coverage. These numerical values of window widths have no special significance and are provided for purposes of example only.

The discussion included in this application is intended to serve as a basic description. The present invention is not to be limited in scope by the specific embodiments described herein, which are intended as single illustrations of individual aspects of the invention, and functionally equivalent methods and components are within the scope of the invention. Indeed, various modifications of the invention, in addition to those shown and described herein will become apparent to those skilled in the art from the foregoing description and accompanying drawings. Such modifications are intended to fall within the scope of the appended claims. Any patents, patent applications, patent application publications or other literature mentioned herein are hereby incorporated by reference herein in their respective entirety as if fully set forth herein, except that, in the event of any conflict between the incorporated reference and the present specification, the language of the present specification will control.

What is claimed is:

1. A method of acquiring and analyzing mass spectra of a sample comprising:

delivering the sample into an ion source of a mass spectrometer and generating first-generation ions from the sample using the ion source;

repeatedly performing a cycle comprising:

acquiring a series of survey mass spectra of the first-generation ions using a mass analyzer of the mass spectrometer; and acquiring a series of fragment-ion mass spectra using the mass spectrometer, each fragment-ion spectrum comprising a record of a respective set of fragment-ion species generated by fragmentation of a respective subset of the first-generation ions, said respective subset of the first-generation ions comprising a respective isolated range of mass-to-charge ratio (m/z) values, the series of isolated ranges, taken together, including all m/z values within a range of interest of m/z values;

dividing the acquired series of fragment-ion mass spectra into a first group and a second group, wherein an appearance of a fragment-ion species signature observed in each fragment-ion mass spectrum of the first group correlates with the appearance of a first-generation ion species signature observed in a survey mass spectrum and wherein, in the second group, no correlation is observed between signatures of fragment-ion species and signatures of first-generation ion species; and mathematically processing the fragment-ion spectra of the first and second groups by different mathematical processing procedures, wherein at least one mass spectrometer operational parameter used to acquire at least one of the survey mass spectra is adjusted based on results of an earlier-acquired one of the survey mass spectra.

2. A method as recited in claim 1, wherein the series of isolated ranges of each cycle is identical to the series of isolated ranges of each and every other cycle.

3. A method as recited in claim 1, wherein the fragment-ion spectra of the first group are mathematically processed by reference to at least one database comprising lists of fragment-ion species ink values that generated by fragmentation of precursor-ion species of known fragment-ion species ink values and wherein the fragment-ion spectra of the second group are mathematically processed without reference to any precursor-ion species.

4. A method as recited in claim 1, wherein each of the survey mass spectra acquired during an individual cycle comprises a respective sub-range of ink values of the range of interest of ink values.

5. A method as recited in claim 4, wherein each respective sub-range comprises includes at least one ink value of a targeted precursor ion species of interest.

6. A method as recited in claim 4, wherein each respective sub-range comprises includes multiple ink values of respective targeted precursor ion species of interest.

7. A method as recited in claim 4, wherein the adjusting includes shifting at least one survey spectrum sub-range of ink values relative to a sub-range of ink values employed during acquisition of a survey mass spectrum of an earlier cycle.

8. A method as recited in claim 4, wherein the sub-ranges of ink values of a plurality of cycles, taken together, encompass the entirety of the range of interest first-generation ion ink values.

9. A method as recited in claim 4 wherein the sub-ranges of ink values and the isolated ranges of mass-to-charge ratio (m/z) values are independent of one another.

10. A method as recited in claim 1, wherein different respective mass analyzers of the mass spectrometer are used to acquire the survey mass spectra and the fragment-ion mass spectra.

11. A method as recited in claim 1 wherein, during the performing of each cycle, acquisitions of the survey mass spectra are interspersed with acquisitions of the fragment-ion mass spectra.

12. A method as recited in claim 1 wherein the adjusting of the at least one mass spectrometer operational parameter used to acquire at least one of the survey mass spectra includes adjusting one or more of the group consisting of: a time duration of injection of ions into a mass analyzer, a target maximum number of ions to inject during an injection of ions into a mass analyzer and a mass spectral resolution.

13. A method as recited in claim 1 wherein the adjusting of the at least one mass spectrometer operational parameter used to acquire at least one of the survey mass spectra comprises choosing a one of two or more mass analyzers of the mass spectrometer to employ for acquisition of the at least one survey mass spectrum.

14. A method as recited in claim 1 wherein a number of survey mass spectra acquired per cycle is not constant among all cycles.

15. A method as recited in claim 3, further comprising:

identifying the presence of a first peptide in the sample by observing a match between an entry in a database of tabulated precursor-ion and fragment-ion m/z values and a pair of m/z values observed in the acquired mass spectra, one member of the pair comprising an m/z value observed in a survey mass spectrum and the other member of the pair observed in a fragment-ion mass spectrum; and identifying the presence of a second peptide in the sample by observing a match between an observed pattern of a plurality of observed fragment-ion m/z values and an expected pattern of fragment-ion m/z values.

16. A method as recited in claim 1 wherein the delivering the sample into the ion source of the mass spectrometer comprises delivering the sample as separated sample fractions over the course of chemical fractionation of the sample.

* * * * *